US007962334B2

(12) United States Patent
Tashiro

(10) Patent No.: US 7,962,334 B2
(45) Date of Patent: Jun. 14, 2011

(54) RECEIVING DEVICE AND METHOD

(75) Inventor: Atsushi Tashiro, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 1451 days.

(21) Appl. No.: 10/577,037

(22) PCT Filed: Oct. 27, 2004

(86) PCT No.: PCT/JP2004/015894
§ 371 (c)(1),
(2), (4) Date: Apr. 24, 2006

(87) PCT Pub. No.: WO2005/046096
PCT Pub. Date: May 19, 2005

(65) Prior Publication Data

US 2007/0136073 A1 Jun. 14, 2007

(30) Foreign Application Priority Data

Nov. 5, 2003 (JP) ..... 2003-376088

(51) Int. Cl.
*G10L 19/14* (2006.01)

(52) U.S. Cl. ..... 704/225; 704/224

(58) Field of Classification Search ..... None
See application file for complete search history.

(56) References Cited

U.S. PATENT DOCUMENTS 4,554,670 A 11/1985 Aiko et al.
4,611,342 A * 9/1986 Miller et al. ..... 704/225
4,975,657 A * 12/1990 Eastmond ..... 330/279
5,313,472 A * 5/1994 Hara ..... 714/747
5,506,934 A * 4/1996 Kawama ..... 704/258
5,586,126 A * 12/1996 Yoder ..... 714/746
7,337,112 B2 * 2/2008 Moriya et al. ..... 704/228

(Continued)

FOREIGN PATENT DOCUMENTS

CN 1243615 A 2/2000

(Continued)

OTHER PUBLICATIONS

Technical Paper of the Telecommunication Standardization Sector of ITU ITU-T Recommendation G. 711 Appendix-I, 1999.

(Continued)

*Primary Examiner* — Brian L Albertalli
(74) *Attorney, Agent, or Firm* — Venable LLP; Michael A. Sartori; Kyle D. Petaja

(57) ABSTRACT

A receiving device receives a transmission unit signal that is sent from a sending end and accommodates a result of dividing, the result of the dividing being obtained by quantizing a value based on relative differences between a plurality of sampling values having temporal prior-posterior relationship therebetween, and dividing data produced in a time series in accordance with a result of the quantizing, at the sending end. The receiving device includes a need-of-adjustment determining means which determines whether or not an amplitude adjustment needs to be made in accordance with a value of an amplitude of a signal waveform indicated by a decoding result of the produced data accommodated in the transmission unit signal; and an amplitude adjusting means which transparently passes the signal waveform when the need-of-adjustment determining means determines that the amplitude adjustment does not need to be made, and performs predetermined amplitude adjusting processing to pass the signal waveform when the need-of-adjustment determining means determines that the amplitude adjustment needs to be made.

8 Claims, 4 Drawing Sheets

U.S. PATENT DOCUMENTS

| | | | | |
|---|---|---|---|---|
| 7,693,710 | B2 * | 4/2010 | Jelinek et al. | 704/207 |

FOREIGN PATENT DOCUMENTS

| | | | |
|---|---|---|---|
| JP | 58-179037 | A | 10/1983 |
| JP | 6-334613 | A | 12/1994 |
| WO | WO-99/13570 | A1 | 3/1999 |

OTHER PUBLICATIONS

Technical Paper of the Telecommunication Standardization Sector of ITU ITU-T Recommendation G. 711, 1993.
Technical Paper of the Telecommunication Standardization Sector of ITU ITU-T Recommendation G. 726, 1990.

* cited by examiner

RECEIVING DEVICE AND METHOD

TECHNICAL FIELD

The present invention relates to a receiving device and method, and is suitably applied to the case of conducting real-time communication such as an IP telephone using a VoIP technology, for example.

BACKGROUND ART

At present, voice communication using a network such as the Internet has been actively conducted by the use of the VoIP technology.

In communication over a network such as the Internet in which the communication quality is not assured, a packet loss that a packet is lost during transmission frequently causes a phenomenon that a part of voice data, which is supposed to be received in a time series under normal circumstances, is lost. When a voice loss occurs, if the voice data is decoded as it is, voice is frequently interrupted to degrade the voice quality. A technology disclosed in non-patent document 1 to be described below has been already known as a method for compensating this degradation.

In this method, a sampling frequency of 8 kHz is described for voice and the occurrence of a voice loss is monitored for each voice frame (packet) of a decoding processing unit and every time a voice loss occurs, compensation processing is performed. Because voice data after decoding a series of coding data is stored in an internal memory or the like, when the voice loss occurs, a period near a portion where the voice loss occurs is obtained on the basis of the voice data read from the internal memory. Voice data is taken out of the internal memory and interpolation is performed to a frame in which voice data need to be interpolated because of the voice loss so that the starting phase of the frame matches with the ending phase of a frame immediately preceding the frame to thereby secure continuity of a waveform period.

Meanwhile, technologies described in non-patent documents 2 and 3 to be described below are known as a method of voice communication over a network.

In the technology described in the non-patent document 2, the amplitude values of sampling voice are quantized just as they are. In the technology described in the non-patent document 3 is used a difference quantization method for quantizing the amount of change in an amplitude value between sampling points.

In a difference quantization method, a difference in a voice signal between sampling points is obtained by an encoder for encoding voice and is quantized to make a difference signal and the difference signal is transmitted. A decoder for receiving the transmitted difference signal decodes the received difference signal to an original voice signal. In this difference quantization method, the encoder and the decoder have common internal variables used for computing and converting the difference signal and the original signal. Hence, the internal variables in the encoder and the decoder are always updated for the time period during which the encoder and the decoder are operating.

Non-patent document 1: ITU-T Recommendation G.711 Appendix I

Non-patent document 2: ITU-T Recommendation G.711

Non-patent document 3: ITU-T Recommendation G.726

DISCLOSURE OF THE INVENTION

Problem to be Solved by the Invention

Incidentally, when the amplitude value of sampling voice is quantized just as it is as described in the non-patent document 2, there is no problem, but when a difference quantization method for quantizing the amount of change in the amplitude value between sampling points is used, there is a possibility that when a communication device for receiving a voice frame performs an operation reverse to the quantization (reverse quantization) to produce a discrete value in the direction of amplitude, an expected extremely discrete value develops. This is caused by the following reason: that is, in difference quantization or the like, when a certain discrete value is produced by reverse quantization, the discrete value is determined in accordance with a temporally prior (or posterior) discrete value; and hence there remains a possibility that even if the value of voice data itself for interpolation obtained by some method is close to original voice data lost by the above-mentioned voice loss, a discrete value extremely different from its original value is produced in the process of reverse quantization.

In an actual device, this can be reflected, for example, in the form of developing a discontinuous jump in an internal variable of the decoding device. Moreover, when an unexpected extremely discrete value like this is produced at the time of executing reverse quantization, there is a high possibility that a user (a person hearing the voice output) feels an extremely large abnormal voice output in an actual voice output as compared with a voice output having been performed hitherto (or to be performed thereafter) and hence recognizes it as a remarkable degradation in the communication quality. Therefore, this degrades the communication quality.

Means for Solving the Problem

In order to solve the above-mentioned problem, according to the first embodiment, a receiving device receives a transmission unit signal that is sent from a sending end and accommodates a result of dividing, the result of the dividing being obtained by quantizing a value based on relative differences between a plurality of sampling values having temporal prior-posterior relationship therebetween, and dividing data produced in a time series in accordance with a result of the quantizing, at the sending end. The receiving device includes a need-of-adjustment determining means which determines whether or not an amplitude adjustment needs to be made in accordance with a value of an amplitude of a signal waveform indicated by a decoding result of the produced data accommodated in the transmission unit signal; and an amplitude adjusting means which transparently passes the signal waveform when the need-of-adjustment determining means determines that the amplitude adjustment does not need to be made, and performs predetermined amplitude adjusting processing to pass the signal waveform when the need-of-adjustment determining means determines that the amplitude adjustment needs to be made.

Further, according to the second embodiment, a receiving method for receiving a transmission unit signal that is sent from a sending end and accommodates a result of dividing, the result of the dividing being obtained by quantizing a value based on relative differences between a plurality of sampling values having temporal prior-posterior relationship therebetween, and dividing data produced in a time series in accordance with a result of the quantizing, at the sending end. The receiving method includes the steps of: determining whether or not an amplitude adjustment needs to be made in accordance with a value of an amplitude of a signal waveform indicated by a decoding result of the produced data accommodated in the transmission unit signal, by a need-of-adjustment determining means; and transparently passing the signal waveform when the need-of-adjustment determining means determines that the amplitude adjustment does not need to be made, and performing predetermined amplitude adjusting processing to pass the signal waveform when the need-of-adjustment determining means determines that the amplitude adjustment needs to be made, by an amplitude adjusting means.

Effect of the Invention

According to the present invention, the communication quality can be improved.

DESCRIPTION OF THE REFERENCE SYMBOLS

11 decoder; 12 adjuster; 13 interpolator; 14 loss determining device; 21 sum total calculator; 22 determining device; 23 corrector; 31 positive/negative determining device; 32 sum total integrator; 33 positive-number sum total integrator; 34 negative-number sum total integrator; 70 communication system; 71 network; 72, 73 communication terminal; P11-P26 sampling point; PK11-PK13 packet (voice frame).

BEST MODE FOR CARRYING OUT THE INVENTION

(A) Embodiment

An embodiment will be described below by taking a case, in which a receiving device and a receiving method according to the present invention are applied to voice communication using the above-mentioned difference quantization, as an example.

(A-1) Construction of First Embodiment

Figure 7:
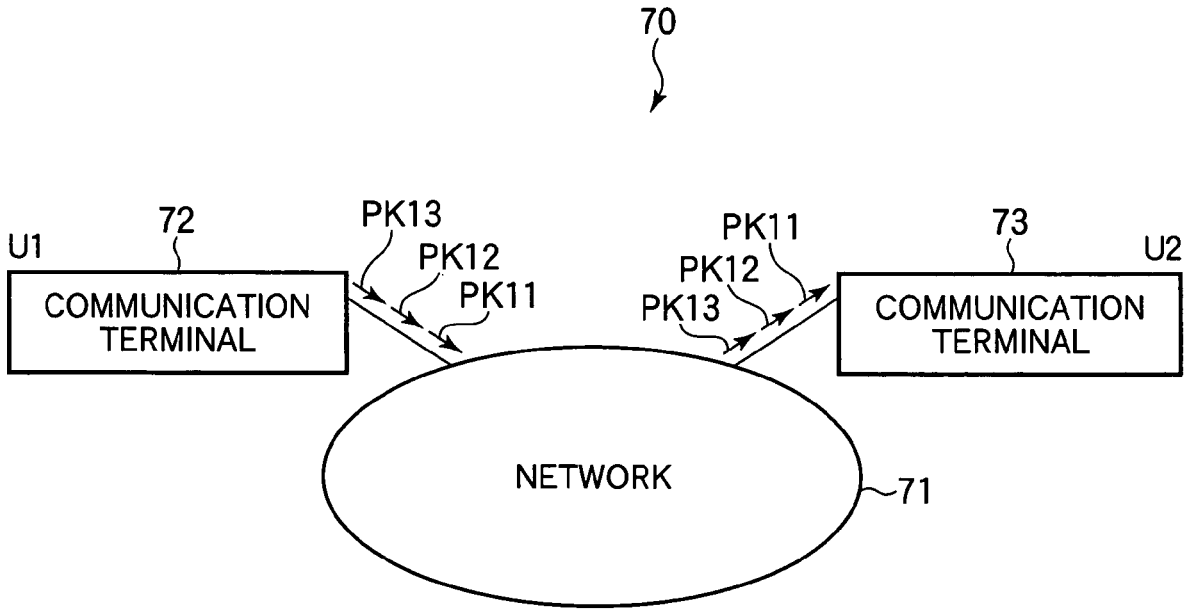
FIG. 7 is a schematic diagram showing the whole construction example of a communication system according to the first to third embodiments.

The whole construction example of a communication system 70 in accordance with the present embodiment is shown in FIG. 7.

Referring to FIG. 7, the communication system 70 includes a network 71 and communication terminals 72 and 73.

Among them, the network 71 may be the Internet and may be other network such as an IP network that is provided by a communications carrier and has the communication quality assured to some extent.

Moreover, the communication terminal 72 is a communication device capable of conducting a voice conversation in real time, such as an IP telephone set. The IP telephone set uses a VoIP technology to make it possible to conduct a telephone conversation by exchanging voice data over a network using an IP protocol. The communication terminal 73 is also the same communication device as the communication terminal 72.

The communication terminal 72 is used by a user U1 and the communication terminal 73 is used by a user U2. Commonly, voice is exchanged bidirectionally in the IP telephone set so as to establish the conversation between the users. Here, description will be provided by paying attention to a case where voice frames (voice packets) PK11 to PK13 are sent from the communication terminal 72 and a direction in which these packets are received by the communication terminal 73 via the network 71.

These packets PK11 to PK13 include voice data indicating contents uttered by the user U1. Hence, insofar as its direction is concerned, the communication terminal 73 performs only receiving processing and the user U2 only hears voice uttered by the user U1.

These packets are sent in the order of PK11, PK12, PK13, . . . and, in many cases, all of the packets are received by the communication terminal 73 in this order without a dropout. However, a packet loss may be caused by the event of congestion of a router (not shown) on the network 71. The packet lost by a packet loss may be, for example, PK12.

Figure 1:
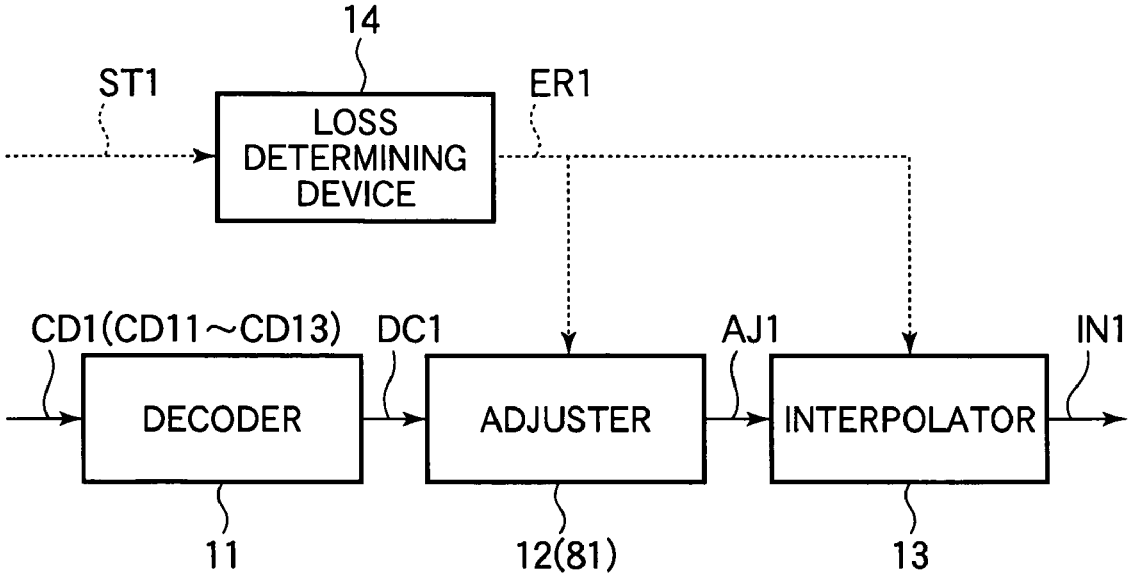
FIG. 1 is a schematic diagram showing a construction example of a main portion of a communication terminal used in the first to third embodiments.

The present embodiment is characterized in the function of a receiving end and hence description will be provided hereinafter by paying attention to the communication terminal 73. The construction example of a main portion of the communication terminal 73 is shown in FIG. 1. Naturally, the communication terminal 72 may be provided with the same construction as this so as to perform receiving processing.

(A-1-1) Construction Example of Communication Terminal

Referring to FIG. 1, the communication terminal 73 includes a decoder 11, an adjuster 12, an interpolator 13, and a loss determining device 14.

Among them, the decoder 11 is a part that decodes voice data CD1 extracted from a packet (for example, PK11) received by the communication terminal 73 and outputs a decoding result DC1. Because the communication terminal 72 on a sending end performs difference quantization when the communication terminal 72 produces the voice data CD1 by encoding, the decoder 11 included in the communication terminal 72 on a receiving end performs reverse quantization corresponding to the difference quantization in this decoding.

The loss determining device 14 is a part that detects the occurrence of the packet loss (voice loss) on the basis of basic information ST1 and outputs the state-of-loss detection result ER1. When the packet loss occurs, the functions of the adjuster 12 and the interpolator 13 are necessary and hence the loss determining device 14 sends a notice to this effect in accordance with the state-of-loss detection result ER1 to the adjuster 12 and the interpolator 13.

Various methods can be used as a method for detecting a packet loss. For example, when a dropout occurs in a sequence number (a serial number that the communication terminal 72 assigns at the time of sending a packet) that is held by a RTP header and the like accommodated in each packet and is to supposed be a serial number, the loss determining device can determine that a packet loss occurs. Further, when a packet is delayed to an excessively large amount in terms of the value of a time stamp (information of a sending time that the communication terminal 72 assigns at the time of sending the packet) held by the RTP header, the loss determining device can determine that a packet loss occurs. In the case of using a sequence number, the basic information ST1 becomes the sequence number and in the case of using a time stamp, the basic information ST1 becomes the time stamp.

There is a possibility that a packet once determined to be lost by a packet loss will be received later but, in this case, the received packet may be discarded. This is because voice data that is not received before timing to be received cannot be used for outputting voice in real-time communication.

However, in the case of determining a packet loss on the basis of a sequence number, when a packet is received at the timing when there is still time to output voice, there is a possibility that the received packet can be used for outputting voice by exchanging the order of the received packet in the communication terminal 73. Hence, in the case of exchanging the order of the received packet in this manner, it is advisable to make consideration not to make the timing of sending a notice of a packet loss in accordance with the state-of-loss detection result ER1 too early.

The interpolator 13 is a part that interpolates the interpolation voice information into a series of voice information (adjustment result) AJ1 outputted from the decoder 11 and adjusted by the adjuster 12 and outputs an interpolation result IN1. When the state-of-loss detection result ER1 indicates a voice loss, the interpolator 13 interpolates the interpolation voice (interpolation voice information) produced by a predetermined method into a time period corresponding to the voice loss.

Various methods can be used for producing interpolation voice. If necessary for producing the interpolation voice, the interpolator 13 may store a new adjustment result among the adjustment result AJ1 supplied from the adjuster 12 and may produce the interpolation voice from the adjustment result AJ1 just before the voice loss.

It is possible to interpose the interpolator 13 between the decoder 11 and the adjuster 12 and to adjust voice information after interpolation by the adjuster 12. Moreover, it is also possible to arrange the interpolator 13 at a stage before the decoder 11 and to perform interpolation before decoding. However, in the present embodiment, as shown in the drawing, the interpolator 13 is arranged at a stage after the adjuster 12 and hence interpolation is performed after adjustment.

Even when the interpolation is performed at either of these positions, what is interpolated by interpolation is pseudo voice information different from the original voice information. Hence, only by the interpolation, an unexpected extremely discrete value is produced in the reverse quantization performed by the decoder 11, as described above, and hence it is impossible to prevent the degradation of the voice quality output outputted from the communication terminal 73.

Therefore, in the present embodiment, the degradation of the voice quality output relating to the connection of a time period during which a voice loss occurs (into which interpolation voice information is interpolated) and its subsequent time period is lessened by the use of the adjuster 12.

The adjuster 12 determines whether or not adjustment is necessary by finding a direct current tendency relating to the decoding result DC1 supplied from the decoder 11. When the adjuster 12 determines that adjustment is necessary, the adjuster 12 adjusts the value of amplitude indicated by the decoding result DC1. When the adjuster 12 determines that adjustment is not necessary, the adjuster 12 does not perform any processing but transparently passes the decoding result DC1 (in this case, DC1 becomes AJ1 as it is) and delivers the adjustment result AJ1 to the interpolator 13 at the subsequent stage.

Figure 2:
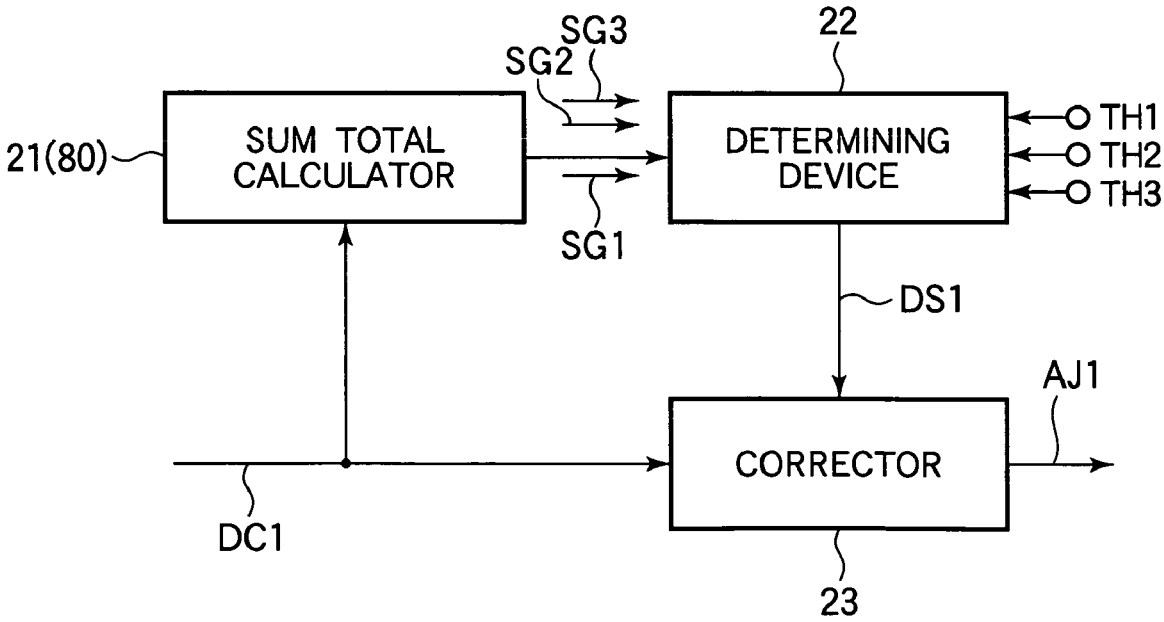
FIG. 2 is a schematic diagram showing a construction example of an adjuster included in the communication terminal used in the first and second embodiments.

The detailed construction of the adjuster 12 like this is shown in FIG. 2.

(A-1-2) Detailed Construction of Adjuster

Referring to FIG. 2, the adjuster 12 includes a sum total calculator 21, a determining device 22, and a corrector 23.

Among them, the sum total calculator 21 is basically a part that finds a direct current tendency relating to the decoding result DC1. The direct current tendency obtained by the sum total calculator 21 is expressed by three pieces of sum total information SG1 to SG3 to be described later.

The sum total calculator 21 does not operate in a time period where a voice loss does not occur and in a time period where voice loss occurs, but operates at the timing when a voice loss disappears. This is because an effective decoding result DC1 to be processed does not exist in a time period during which a voice loss occurs until the voice loss disappears. For example, if the occurrence of the voice loss (packet loss) and the reception of the packet are explicitly shown in the above-mentioned state-of-loss detection result ER1, it is possible to cause the sum total calculator 21 to start to operate at the timing when the state-of-loss detection result ER1 first indicates the reception of the packet after the state-of-loss detection result ER1 indicates the voice loss.

As to a time period during which the sum total calculator 21 is caused to continuously operate after it starts to operate (this time period corresponds to a processing time period during which the corrector 23 performs amplitude adjusting processing to be described later), various modifications can be thought.

It is advisable to match this processing time period with, for example, the size of a packet (in a strict sense, the size of voice data accommodated in the packet (for example, CD11)). In this case, when the size of voice data in one packet varies, the length of the processing time period is varied in accordance with the variation of the size. This is because it is more effective that the processing unit of the adjuster 12 is one packet (in a strict sense, one voice data accommodated in one packet) just as with the decoder 11.

Figure 3:
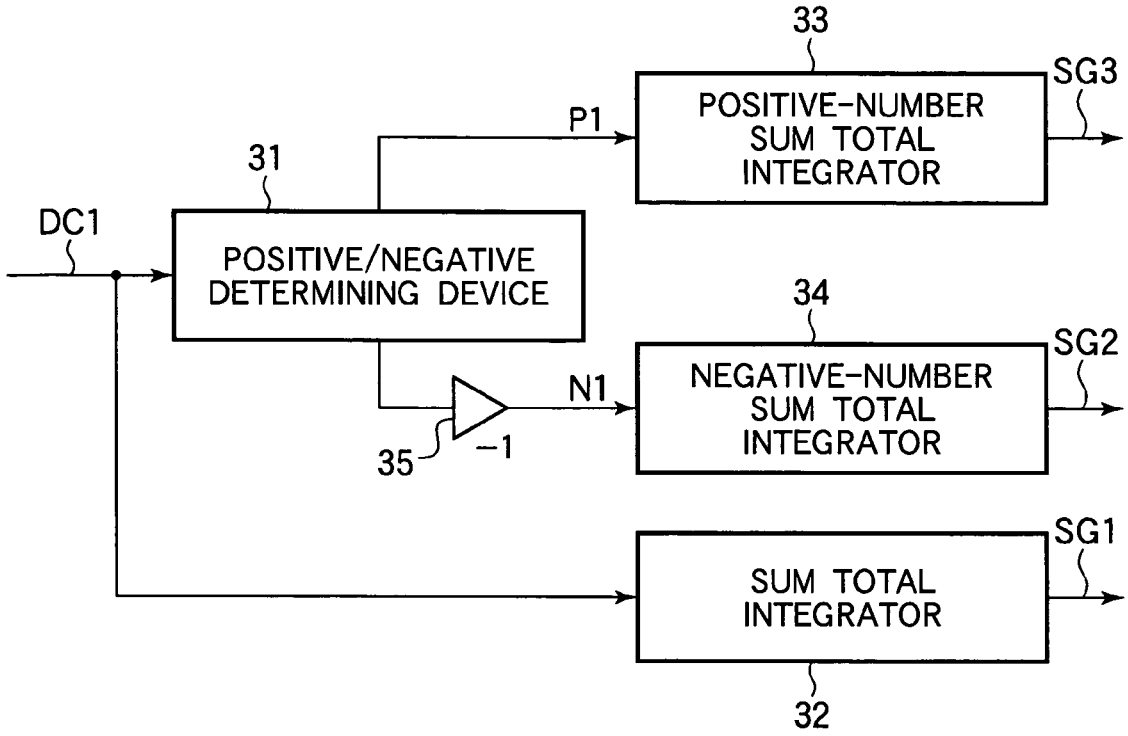
FIG. 3 is a schematic diagram showing a construction example of a sum total calculator included in the communication terminal used in the first embodiment.

As shown in FIG. 3, the sum total calculator 21 includes a positive/negative determining device 31, a sum total integrator 32, a negative-number sum total integrator 34, a positive-number sum total integrator 33, and a positive/negative converter 35.

Among them, the sum total integrator 32 is a part that integrates discrete values (amplitude values) included in the decoding result DC1 for the processing time period and outputs its integration result.

The sum total integrator 32 integrates all of discrete values existing for the processing time period and outputs its integration result as entire sum total information SG1. Hence, for example, when discrete values of nearly same magnitude and of nearly same number exist in a positive direction and in a negative direction for the processing time period, almost all of them are canceled and hence the value of the entire sum total information SG1 becomes zero or close to zero. However, when the discrete values are extremely different in magnitude between in the positive direction and in the negative direction or when the discrete values are extremely different in number between in the positive direction and in the negative direction, the discrete values that are not canceled but remain increase in number and hence the value (absolute value) of the entire sum total information SG1 becomes large.

Figure 8:
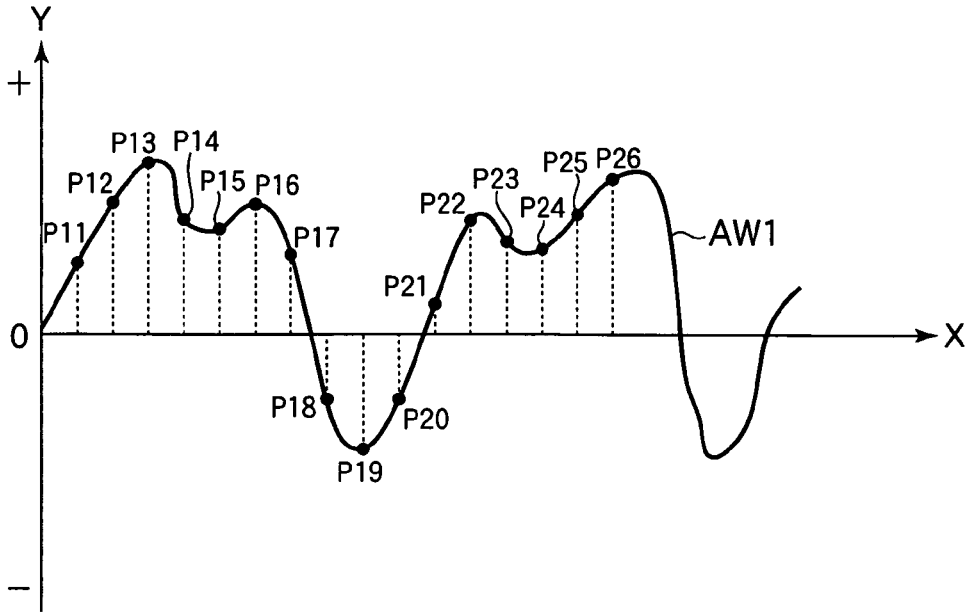
FIG. 8 is a diagram for describing the operation of the first to third embodiments.

FIG. 8 shows one example of a voice waveform. Referring to FIG. 8, a horizontal axis X denotes a time axis (a time range shown in the drawing is extremely shorter as compared with the above-mentioned processing time period) and a vertical axis Y denotes an amplitude axis. A region above an origin 0 of Y axis is a positive (+) side and a region below the origin is a negative (−) side. The timing of sampling is denoted by a dotted line and hence the respective points P11 to P26 of intersection of the respective dotted lines and the voice waveform AW1 become sampling points. Although quantization noises are actually included, basically, the amplitude values (values in Y coordinate) indicated by the respective sampling points (for example, P11) correspond to the discrete values (amplitude values) after difference quantization. However, the difference quantization is different from the quantization disclosed in the non-patent document 2 and is to quantize the amount of change in the amplitude value between the sampling points, which has been already described, as is disclosed in the non-patent document 3.

The positive/negative determining device 31 determines for the processing time period whether the respective discrete values included in the decoding result DC1 (for example, corresponding to the respective sampling points P11 to P26) are positive or negative (are above or below the origin 0 on the Y axis). The positive/negative determining device 31 supplies the discrete value, which is determined to be positive, as positive-number voice P1 to the positive-number sum total integrator 33 and supplies the discrete value, which is determined to be negative, as negative-number voice N1 to the negative-number sum total integrator 34. Depending on the state of specific mounting, when the negative-number voice N1 has a negative sign, in not a few cases, if the negative-number voice N1 is subjected to the operation of eliminating a negative sign via the positive/negative converter 35, as shown in FIG. 3, the processing of handling the positive and negative signs in the subsequent processing is not required to thereby increase the efficiency of processing.

The positive-number sum total integrator 33 is a part that integrates values indicated by the supplied positive-number voice P1 and outputs its integration value as positive sum total information SG3. This positive sum total information SG3 corresponds to, for example, the area of a portion whose Y coordinate is larger than zero of a region surrounded by the waveform AW1 and the X axis in FIG. 8.

The negative-number sum total integrator 34 is a part that integrates values indicated by the supplied negative-number voice N1 and outputs its integration value as negative sum total information SG2. This negative sum total information SG2 corresponds to, for example, the area of a portion whose Y coordinate is smaller than zero of the region surrounded by the waveform AW1 and the X axis in FIG. 8.

These sum total information SG1 to SG3 are supplied to the determining device 22 shown in FIG. 2.

Referring to FIG. 2, the determining device 22 is a part that determines on the basis of the sum total information SG1 to SG3 whether or not the above-mentioned unexpected extremely discrete value (in many cases, extremely large abnormal amplitude value) develops and outputs determination result DS1.

Although there is a possibility that various methods can be used for determining whether or not the above-mentioned unexpected extremely discrete values exist on the basis of these sum total information SG1 to SG3, it is assumed here that the following determination methods CR1 and CR2 are used.

CR1: when the absolute value of the entire sum total information SG1 exceeds a predetermined threshold value TH1, it is determined that an extremely discrete value exists.

CR2: it is checked which is larger between the negative-number sum total information SG2 and the positive-number sum total information SG3 that are inputted at the same time, and when the larger one exceeds a predetermined threshold value TH2 and the smaller one is smaller than a predetermined threshold value TH3, it is determined that an extremely discrete value exists.

In other words, when it is determined that an extremely discrete value does not exist by either of these determination methods CR1 and CR2, voice data is determined to be normal. Even when a voice loss occurs, depending on the contents of conversation of the user U1 before and after the time period of the voice loss (for example, when the user U1 does not utter anything and is silent), there is also a possibility that an extremely discrete value does not develop.

The above-mentioned threshold values TH1, TH2, and TH3 can be set at various numbers and, by way of example, it is advisable to set TH1 at 300, TH2 at 200, and TH3 at 100.

When the determination result DS1 by the determining device 22 shows that the extremely discrete value does not develop, the corrector 23 for receiving the determination result DS1 and the decoding result DC1 transparently passes the decoding result DC1 without executing any processing to it. When the determination result DS1 indicates that the extremely discrete value develops, the corrector 23 adjusts the determination result DC1 in such a way as to eliminate the extremeness by changing the discrete value of the decoding result DC1 and then passes the determination result DC1. In either of these cases, the decoding result DC1 passing through the corrector 23 is supplied as adjustment result AJ1 to the interpolator 13.

Various methods can be used for an adjusting method for eliminating extremeness (amplitude adjusting processing). For example, the extremely discrete value can be changed to a value close to its amplitude with reference to the amplitude of interpolation voice (interpolation voice information) produced by the interpolator 13. However, when there is a strong tendency for extremeness to develop in a direction to increase the amplitude value or, in particular, in the case where the extremeness develops in a direction to increase the amplitude value, when there is a strong tendency for the extremeness to give the user U2 a sense of large discomfort, the amplitude value can be also changed to zero with ease. Moreover, it is also advisable to eliminate the extremeness by moving the waveform axis.

The moving of the waveform axis is, for example, an operation corresponding to moving the waveform AW1 parallel in the Y-axis direction. In the case of the waveform AW1, because the waveform Aw1 is biased in the positive direction of Y axis, if the moving of the waveform axis is applied to the waveform AW1, the waveform AW1 is moved parallel in the negative direction of Y axis.

Although any of the method for eliminating extremeness can be used, it is assumed that a method of making an amplitude value zero is used.

The operation of the present embodiment having the above-mentioned construction will be described below.

(A-2) Operation of First Embodiment

Voice uttered by the user U1 is accommodated in the packets PK11, PK12, PK13, . . . sent in a time series from the communication terminal 72 and is received by the communication terminal 73 via the network 71 and is outputted as voice output. This voice output is heard by the user U2. Assuming that the voice data accommodated in the packet PK11 is CD11 and that the voice data accommodated in the packet PK12 is CD12 and that the voice data included in the packet PK13 is CD13, so as to discriminate the voice data CD1 included in the respective packets, voice data CD11, CD12, and CD13 relating to voice information heard by the user U2 construct a series of voice data.

If a packet loss does not occur when the packets PK11 to PK13 are transmitted via the network 71, the state-of-loss detection result ER1 outputted by the loss determining device 14, shown in FIG. 1, in the communication terminal 73 does not indicate the occurrence of a voice loss. Hence, the adjuster 12 passes the decoding result DC1 received from the decoder 11 transparently (as adjustment result AJ1) to the interpolator 13, and the interpolator 13 does not produce and interpolate the interpolation voice.

As long as this state continues, if there is not other cause to degrade the communication quality (the occurrence of large jitters or the like), the communication terminal 73 can continue a voice output at a high level of voice quality.

However, when any one of the packets (here, assumed to be PK12) is lost by a packet loss, the above-mentioned state-of-loss detection result ER1 indicates the occurrence of a voice loss and hence the interpolation voice is produced in the interpolator 13 and, in the adjuster 12, the sum total calculator 21 and the determining device 22 make preparations for starting to operate.

It is at the timing when the state of explicitly indicating the reception of the packet (here, PK13) is brought about after the above-mentioned state-of-loss detection result ER1 indicates the occurrence of the voice loss, that is, at the timing when the voice loss disappears that the sum total calculator 21 and the determining device 22 start to operate.

Here, it is assumed that when decoding (reverse quantization) corresponding to the above-mentioned difference quantization is performed, the reverse quantization of some voice data (here, CD13) of the above-mentioned series of voice data uses the contents of the temporally prior voice data (here, CD12).

Because the voice data CD12 to be used does not exist because of the packet loss (voice loss), the result of the reverse quantization of the voice data CD13 does not become normal but raises a possibility that the above-mentioned extremely discrete value (amplitude value) develops. For example, a portion or all of the time period of this voice data CD13 is included in the above-mentioned processing time period.

When the determining device 22 performs processing by the above-mentioned determination methods CR1 and CR2 on the basis of the sum total information SG1 to SG3 outputted as results produced by the operations of the respective constituent elements 31 to 34 in the sum total calculator 21 and thereby determines that an extremely discrete value (amplitude value) is included in the decoding result DC1 of the voice data CD13, as described above, the corrector 23 changes the amplitude value of the voice data CD13 to zero.

Moreover, an interpolation voice produced by the interpolator 13 is interpolated into the time period of the voice data CD12 lost by the voice loss.

Therefore, in this case, the user U2 hears the decoding result of the voice data CD11, the interpolation voice, and silence (amplitude value is zero) for the time period during which, originally, the user U2 is to hear the voice output corresponding to the decoding result of the voice data CD11, CD12, and CD13 in correspondence to the packets PK11 to PK13.

In this case, the voice quality is inevitably degraded as compared with a case where an original decoding result can be heard. However, as compared with a case where a voice output corresponding to the above-mentioned extremely discrete value is produced for the time period corresponding to the voice data CD13, the connection of the state of silence for the time period corresponding to the voice data CD13 and the decoding result of the voice data CD11 or the interpolation voice becomes natural and the connection of the state of silence and the decoding result of the voice data accommodated in the subsequent packet (packets received after the PK13) becomes smooth, which results in giving the user U2 a sense of little discomfort. This can reduce the degree of degradation of the communication quality and hence can produce the higher communication quality than usual.

(A-3) Effect of First Embodiment

According to the present embodiment, it is possible to enhance the communication quality when a packet loss occurs under conditions that the difference quantization is used, as compared with a conventional case.

(B) Second Embodiment

In the following description, only the points in which the present embodiment is different from the first embodiment will be described.

Basically, the present embodiment is different from the first embodiment only in a point relating to the function of the above-mentioned sum total calculator 21. Therefore, FIG. 1 and FIG. 7 also show the construction of the present embodiment just as they are.

To discriminate the sum total calculator of the present embodiment from the sum total calculator 21 of the first embodiment, the sum total calculator of the present embodiment is denoted by a reference numeral 80.

(B-1) Construction and Operation of Second Embodiment

Figure 4:
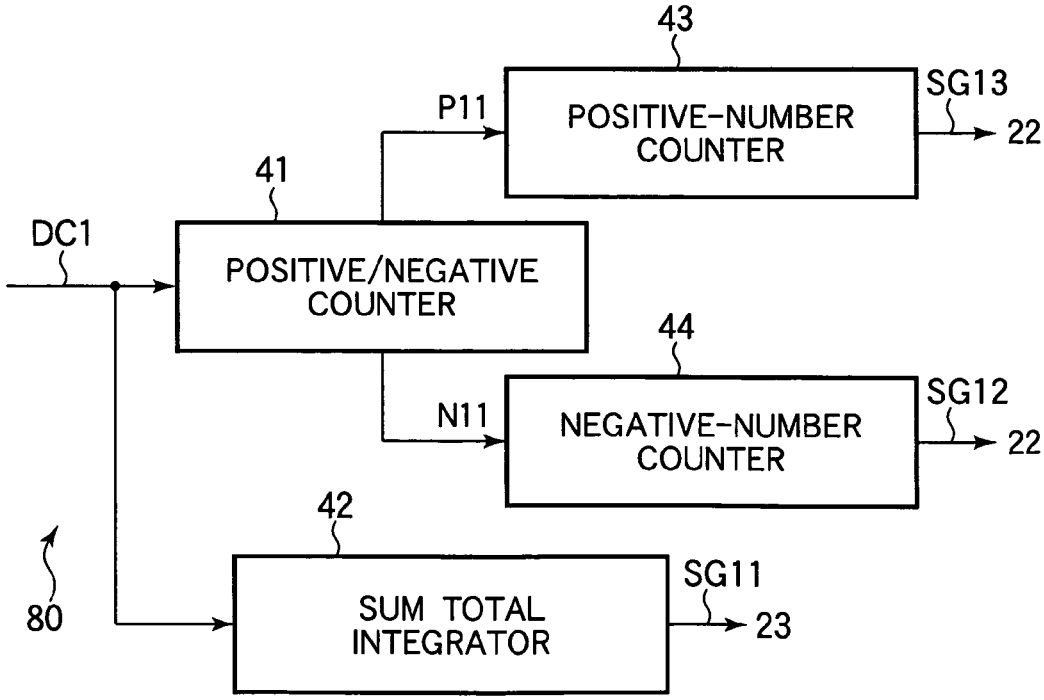
FIG. 4 is a schematic diagram showing a construction example of a sum total calculator included in the communication terminal used in the second embodiment.

The internal construction of the sum total calculator 80 of the present embodiment is shown in FIG. 4.

Referring to FIG. 4, the sum total calculator 80 includes a positive/negative counter 41, a sum total integrator 42, a positive-number counter 43, and a negative-number counter 44.

Among them, the positive/negative calculator 41 is a part that determines whether the respective discrete values (for example, corresponding to the respective sampling points P11 to P26) included in the decoding result DC1 are positive or negative (above or below zero on the Y axis) during the above-mentioned processing time period, when it receives the decoding result DC1 from the decoder 11, and outputs a positive-number determination signal P11 every time the determination result becomes positive and outputs a negative-number determination signal N11 every time the determination result becomes negative.

The positive-number counter 43 that receives the positive-number determination signal P11 is a part that increments, for example, by one (+1) every time it receives the positive-number determination signal P11 to thereby count the number of the received positive-number determination signals P11 (the number of the positive sampling points) and outputs the count result as positive-number count information SG13. The positive-number count information SG13 is supplied to the above-mentioned determining device 22.

Similarly, the negative-number counter 44 that receives the negative-number determination signal N11 is a part that increments, for example, by one (+1) every time it receives the negative-number determination signal N11 to thereby count the number of the received negative-number determination signals N11 (the number of the negative sampling points) and outputs the count result as negative-number count information SG12. The negative-number count information SG12 is supplied to the above-mentioned determining device 22.

The determining device 22 makes a determination on the basis of these two count information SG12 and SG13 and hence its operation is also different from that in the first embodiment. Various methods can be used as a method for determining whether or not the above-mentioned extremely discrete value develops by the use of the count information SG12 and SG13. Here, it is assumed that the following determination method CR3 is used.

CR3: the difference between the number of the positive sampling points indicated by the positive-number count information SG13 and the number of the negative sampling points indicated by the negative-number count information SG12 is obtained and when the absolute value of this difference exceeds a predetermined threshold value TH4, it is determined that an extremely discrete value exists.

Although various values can be set as the value of the threshold value TH4, a value of 20 can be set as one example.

The function of the above-mentioned sum total integrator 42 shown in FIG. 4 is the entirely same as that of the sum total integrator 32 in the first embodiment. Therefore, the entire sum total information SG11 outputted from the sum total integrator 42 is the same as the entire sum total information SG1 of the first embodiment. However, the entire sum total information SG11 of the present embodiment is supplied not to the determining device 22 but to the interpolator 23.

The corrector 23 of the present embodiment that receives this entire sum total information SG11 makes this the amount of direct current in the corresponding time period (for example, time period corresponding to the voice data CD13 when the packet PK12 is lost). The corrector 23 outputs the result obtained by subtracting the amount of direct current from the decoding result DC1 of this time period as the adjustment result AJ1 of this time period. The average value of the entire sum total information SG11 may be made the amount of direct current.

Further, it is preferable that the amount of subtraction in the case of subtracting the amount of direct current is determined in such a way that the amount of subtraction continuously varies for a period between before and after the present processing period. For example, it is also possible to use a method that the amount of direct current of the present packet (for example, a packet PK14 (not shown), which is the next packet of the packet 13), and the amount of direct current of a packet (here, PK13), which precedes the present packet by one, are held as D0 and D1, respectively, and that the amount of subtraction in the processing time period is varied linearly in such a way that the amount of subtraction at the start and the amount of subtraction at the end in the present processing time period (corresponding to PK14) become D1 and D0, respectively.

This processing can be also performed in the same way when a period during which adjustment by the corrector 23 (that is, adjustment of amplitude) is made is shifted to a period during which the adjustment is not made.

The present embodiment is the same as the first embodiment in that even if the above-mentioned state-of-loss detection result ER1 indicates the occurrence of the voice loss, when it is determined by processing in accordance with the determination method CR3 that an extremely discrete value does not develop, the decoding result DC1 is transparently passed without being subjected to any processing.

(B-2) Effect of Second Embodiment

According to the present embodiment, the same effect as the first embodiment can be obtained.

In addition, in the present embodiment, the positive-number counter 43 and the negative-number counter 44, which correspond to the positive-number sum total integrator 33 and the negative-number sum total integrator 34 in the first embodiment, simply count the number of the sampling points. Therefore, when a comparison is made under the same conditions, as compared with a case where the discrete values are integrated just as in the first embodiment, it is possible to decrease the amount of consumption of storage resource and to increase the possibility of increasing a processing speed.

(C) Third Embodiment

In the following description, only the points in which the present embodiment is different from the first and second embodiments will be described.

Basically, the present embodiment is different from the first and second embodiments only in that each processing is performed by the use of an envelope indicated by the above-mentioned decoding result DC1. Therefore, FIG. 1 and FIG. 7 also show the construction of the present embodiment just as they are.

To discriminate the adjuster of the present embodiment from the adjuster 12 of the first embodiment, the adjuster of the present embodiment is denoted by a reference numeral 81.

(C-1) Construction and Operation of Third Embodiment

Figure 5:
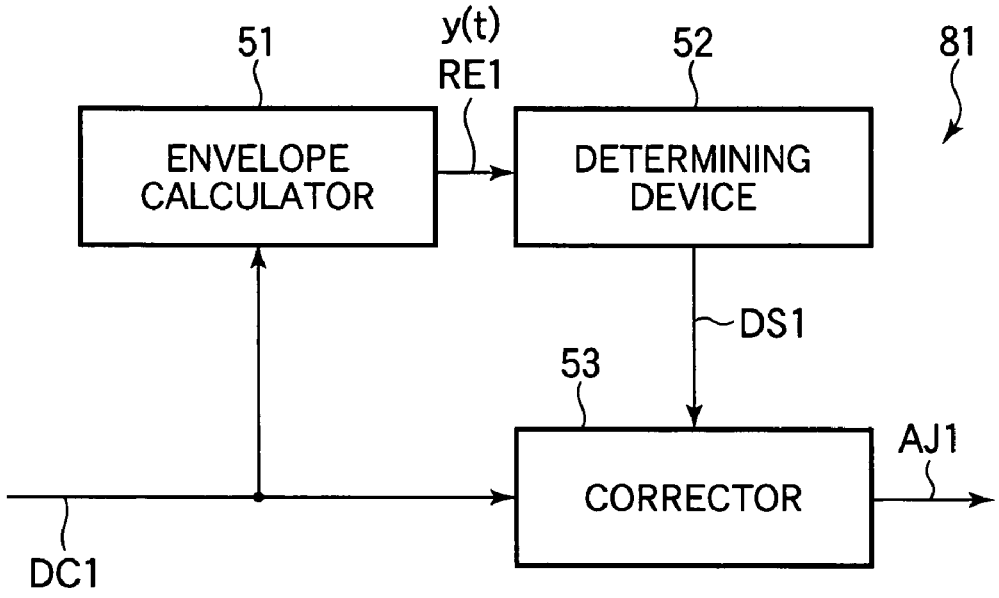
FIG. 5 is a schematic diagram showing a construction example of an adjuster included in the communication terminal used in the third embodiment.

The internal construction of the adjuster 81 of the present embodiment is shown in FIG. 5.

Referring to FIG. 5, the adjuster 81 includes an envelope calculator 51, a determining device 52, and a corrector 53.

Among them, the envelope calculator 51 is a part that calculates the envelope RE1 of the respective discrete values of the decoding result DC1.

Figure 6:
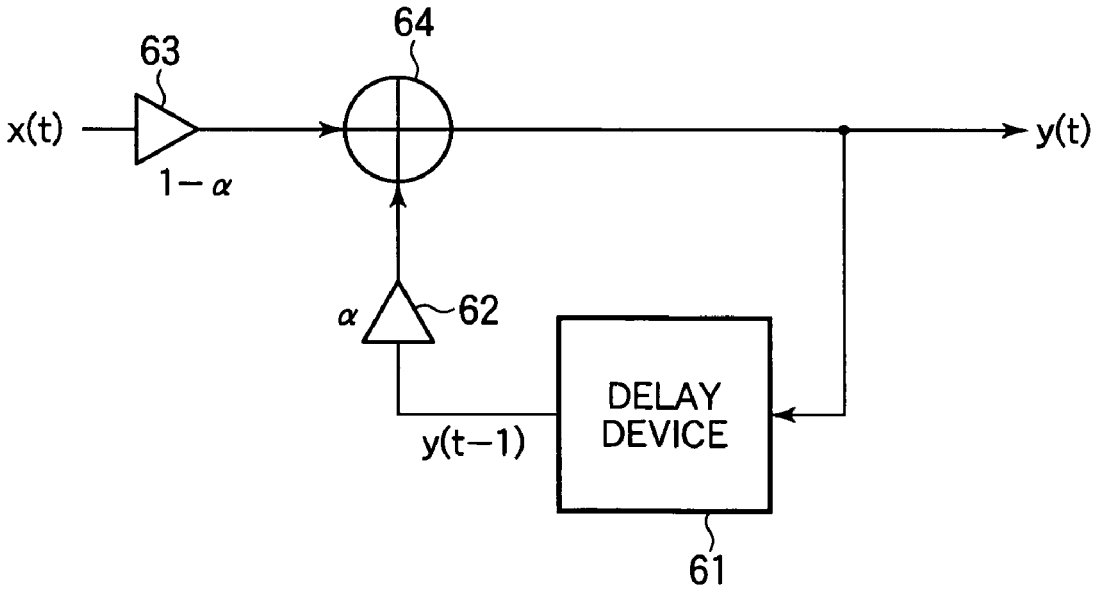
FIG. 6 is a schematic diagram showing a construction example of an envelope calculator included in the communication terminal used in the third embodiment.

For this reason, the envelope calculator 51 includes a circulation type filter including a delay device 61, amplifiers 62 and 63, and an adder 64, as shown in FIG. 6.

Here, the gain $\alpha$ of the amplifier 61 is a positive number smaller than 1 and may be 0.9 as an example.

An input value of x(t), which is to be inputted to the amplifier 63 having a gain of $(1-\alpha)$, corresponds to each discrete value (amplitude value) included in the decoding result DC1 and is an absolute value not including positive and negative signs.

The result obtained by adding the output value from the amplifier 63 and the output value from the amplifier 62 by the adder 64 becomes y(t) of the value of the envelope (envelope value). A value of y(t−1) that is delayed by the delay device 61 and is fed back becomes an input to the amplifier 62 and the result obtained by processing the input value by the amplifier 62 becomes an output value outputted to the adder 64 next time.

When the gain of $\alpha$ is large, a signal component corresponding to the value of y(t−1) circulated through the delay device 61 is strengthened with respect to the envelope of y(t), and when the gain of $\alpha$ is small, a signal component corresponding to a new input value of x(t−1) is strengthened.

The envelope calculator 51 is a part capable of corresponding to the sum total calculator 21 in the first embodiment. However, the sum total calculator 21 in the first embodiment does not operate in a time period during which a voice loss does not occur, whereas the envelope calculator 51 is different from the sum total calculator 21 in that the envelope calculator 51 operate also in the time period during which a voice loss does not occur.

The determining device 52 is the same as the determining device 22 in that the determining device 52 supplies the determination result DS1 to the corrector 53, but a determination method CR4 for obtaining its determination result is different from the determination methods in the first and second embodiments.

To perform this determination method CR4, the determining device 52 needs to always store new one of the envelope values of y(t) produced by the operation of the envelope calculator 51 in a time period during which a voice loss does not occur. In this case, it is recommended that every time a new envelope value of y(t) is supplied, the storage data of envelope values of the same size is deleted (or invalidated) in the order of their occurrence to thereby secure a storage area for storing the new envelope value of y(t).

Then, when a voice loss occurs, the determining device 52 practices the following determination method CR4.

CR4: the newest envelope value of y(t) supplied to the determining device 52 at the timing when a voice loss disappears is compared with a stored envelope value of y(t) (which corresponds to an envelope value just before the occurrence of the voice loss), and when the newest envelope value of y(t) is smaller than the stored envelope value of y(t) as the result of comparison, the voice data is determined to be normal and when the newest envelope value of y(t) is larger than the stored envelope value of y(t), the voice data is determined to have an abnormal amplitude.

The operation (adjustment method) of the corrector 53 that receives the determination result DS1 from the determining device 52 may be the same as the corrector 23 in the second embodiment. However, the following processing is assumed here: that is, a value obtained by dividing the envelope value just before the occurrence of the voice loss, which is stored in the determining device 52, by an envelope value corresponding to each discrete value is taken as the rate of attenuation; the discrete value (amplitude value) included in the decoding result DC1 is multiplied by the rate of attenuation; and the multiplication result is outputted as an adjustment result AJ1. With this, the amplitude is adjusted.

In this regard, the processing of determining the magnitude of the envelope value by the use of the determination method CR4 by the determining device 52 and the processing of adjusting the amplitude by the corrector 53 are repeatedly performed to each discrete value in the decoding result DC1, for example, only during the above-mentioned processing time period.

The envelope value just before the occurrence of a voice loss is here used as a criterion for the comparison and the rate of attenuation. However, the criterion is not limited to this but, for example, the average value of the envelope values in the voice data (for example, the above-mentioned CD11) just before the occurrence of a voice loss may be used as the criterion.

Moreover, as to the processing of adjusting amplitude (adjustment method) in the corrector 53, a method of multiplying the rate of attenuation is not used but the amount of attenuation may be subtracted. The processing of adjusting amplitude is not limited to this method but any method can be used, if the method attenuates a present abnormal amplitude and brings the present abnormal amplitude to amplitude just before the occurrence of a voice loss.

Further, it is also possible to use, for example, a method in which the above-mentioned processing time period is made a period corresponding to the number of the packets (voice data) obtained by multiplying the rate of attenuation (a value from 0 to 1) just after disappearance of a voice loss by ten. Any method can be employed without limitation, if the method can set the upper limit of a period during which amplitude is adjusted by any means.

Still further, to smooth the connection of amplitude between a time period during which amplitude adjustment is made and a subsequent time period, it is recommended that in the end portion of the time period during which the amplitude adjustment is made (for example, for a period of 10 ms at the end), the rate of attenuation just before the period of 10 ms is held and that this rate of attenuation is linearly decreased during the period of 10 ms to continuously shift voice to which amplitude adjustment is made to voice to which amplitude adjustment is not made.

Naturally, a period other than 10 ms may be prepared as this period.

In addition, any method can be used without limitation, if the method can continuously shift voice to which amplitude adjustment is made to the original voice. For example, a method of decreasing the rate of attenuation exponentially can be used.

(C-2) Effect of Third Embodiment

According to the present embodiment, the same effect as the first embodiment can be obtained.

In addition, in the present embodiment, it is checked whether or not an extremely discrete value (amplitude value) exists in the decoding result (DC1) by directly using envelop values corresponding to individual amplitude values and hence the check can be made with higher accuracy.

Moreover, in the present embodiment, the shape of the envelope can be known by using a plurality of continuous envelope values. Hence, in the processing of adjusting amplitude, which is performed by the corrector 53, an adjustment can be made more naturally (with higher fidelity) in accordance with a change in the waveform, which is effective in decreasing or eliminating the sense of discomfort in hearing of the user U2.

(D) Other Embodiments

In the above-mentioned first to third embodiments, the processing time period during which the sum total calculator 21 and the corrector 23, which once start to operate, continue operating is made equal to the size of a packet. However, it is also possible to employ a construction in which the length of a processing time period does not depend on the size of a packet. In this case, for example, a processing time period may be a fixed value of 80 ms.

Moreover, a method may be used by which the period is not set fixedly but is set at a period corresponding to packets (frames) of the number obtained by multiplying the sum total of amplitude by 0.05. Any method can be used without limitation, if the method sets the upper limit of a period, during which amplitude adjustment is made, in some way. Further, it is also possible to determine a period, during which amplitude adjustment is made, by using a period shorter than a period corresponding to one packet as a unit.

Further, the above-mentioned method can be applied also to a case where the amplitude needs to be adjusted over a plurality of packets (frames). For example, the above-mentioned determination method is practiced for each packet, and when the amplitude does not need to be adjusted, the amplitude is not adjusted for the subsequent packets, and when amplitude needs to be adjusted, amplitude is continuously adjusted for the subsequent packets, and these operations are repeatedly performed. At this time, needless to say, an upper limit is set for the number of the repeated packets (frames). A method for setting the above-mentioned upper limit may be used as the method.

Furthermore, in the above-mentioned first to third embodiments, the above-mentioned common processing time period is used in many processing. However, a different processing time period for each processing may be used. For example, the length of a processing time period for finding the entire sum total information SG1 can be made different from the length of a processing for finding the negative-number sum total information SG2 and the length of the positive-number sum total information SG3.

A method other than the above-mentioned method can be used as an adjustment method practiced by the correctors 12 and 81.

Naturally, a combination of the respective embodiments and the adjustment methods can be changed from the above-mentioned combination.

Further, as already described above, the values of the above-mentioned threshold values TH1 to TH4 are not limited to those described above. Furthermore, it is possible that these threshold values TH1 to TH4 are not fixed values but are changed in accordance with the state of input of voice.

Further, it is also possible to find a change in the amplitude of the waveform (for example, AW1) by means other than the circulation type filter irrespective of the third embodiment.

For example, it is also possible to obtain the sum total of absolute values of amplitude values at all sampling points from one sampling point to a predetermined time and to use a series of values, which are obtained by finding the sum totals for respective sampling points, as an envelope.

Further, in the third embodiment, the stored envelope value that becomes a reference is compared with the newest envelope value. However, it is also possible to set an effective range for these envelope values. For example, it is also possible that if the inverse number of the rate of attenuation obtained by dividing the envelope value just before a voice loss, which is stored in the determining device 52, by the newest envelope value is smaller than 1.001, the adjustment of amplitude is finished.

Furthermore, in the first to third embodiment, the adjustment method is practiced for the voice data just after a voice loss (decoding result thereof, for example, DC13). However, which voice data the adjustment method is practiced for depends on and is determined by the procedure of difference quantization to be used and the construction of a device.

For example, when difference quantization is quantization relating to an amplitude value in a certain time period and to quantize the amount of change from an amplitude value in a time period before the certain time period, just as with the first to third embodiments, the adjustment method may be practiced for the voice data just after the occurrence of the voice loss. However, when difference quantization is quantization relating to an amplitude value in a certain time period and to quantize the amount of change from an amplitude value in a time period after the certain time period, there is a possibility that the adjustment method needs to be practiced for the voice data just before the voice loss.

Moreover, in the first to third embodiments, when the packet loss (vice loss) occurs, the adjuster (12 and 81) is given a chance of operating to make the amplitude adjustment. However, there is a possibility that the adjuster can make the amplitude adjustment also when the packet loss does not occur.

For example, when the occurrence of an error in the transmission of a certain packet (frame) is detected, the adjuster (12 and 81) may be given a chance of operating. This is because even when a packet can be received, when an error in transmission is detected, there is a possibility that voice data in the packet may be destroyed to develop the above-mentioned extremely discrete value (amplitude value).

While the voice communication has been described by way of example in the first to third embodiments, there is a possibility that the present invention can be applied to real-time communication other than voice communication. For example, the present invention may be applied to the communication of moving images data and the like.

Moreover, naturally, it is not necessary to limit a communication protocol to which the present invention is applied to the above-mentioned IP protocol.

While the present invention is realized mainly by means of hardware in the above description, the present invention can be also realized by means of software.

The invention claimed is:

1. A receiving device for receiving a transmission unit signal that is sent from a communication terminal and accommodates a result of dividing, the result of dividing being obtained by quantizing a value based on relative differences between a plurality of sampling values having temporal prior-posterior relationship therebetween, and dividing data produced in a time series in accordance with a result of the quantizing, at the communication terminal, the receiving device comprising:

a loss determining device which determines whether or not an amplitude adjustment needs to be made in accordance with a value of an amplitude of a signal waveform indicated by a decoding result of the produced data accommodated in the transmission unit signal; and an adjuster which transparently passes the signal waveform when the loss determining device determines that the amplitude adjustment does not need to be made, and performs the amplitude adjustment to pass the signal waveform when the loss determining device determines that the amplitude adjustment needs to be made, wherein the adjuster includes one of:

a first amplitude adjustment executing section that makes the amplitude adjustment by shifting a waveform axis of the signal waveform;

a second amplitude adjustment executing section that makes the amplitude adjustment by making an absolute value of the amplitude of the signal waveform smaller than a predetermined reference amplitude; and a third amplitude adjustment executing section that makes the amplitude adjustment by attenuating the amplitude of the signal waveform at a given rate of attenuation.

2. The receiving device according to claim 1, wherein the loss determining device includes:

an amplitude sum total calculating section that calculates a sum total of the results of the quantizing each indicating than the amplitude of the signal waveform; and a determination executing section that compares the sum total calculated by the amplitude sum total calculating section with a previously set first threshold value and determines on the basis of a comparison result whether or not the amplitude adjustment needs to be made.

3. The receiving device according to claim 1, wherein the loss determining device includes:

an amplitude sum total calculating section that calculates a sum total of the results of the quantizing each indicating the amplitude of the signal waveform;

a positive number amplitude sum total calculating section that calculates a sum total of the results of the quantizing each having a positive value out of the results of the quantizing each indicating the amplitude of the signal waveform;

a negative number amplitude sum total calculating section that calculates a sum total of the results of the quantizing each having a negative value out of the results of the quantizing each indicating the amplitude of the signal waveform; and a determination executing section that compares the sum total calculated by the amplitude sum total calculating section with a previously set first threshold value, compares the sum total calculated by the positive-number sum total calculating section with a previously set second threshold value, compares the sum total calculated by the negative number sum total calculating section with a previously set third threshold value, and determines on the basis of the three results of the comparing whether or not amplitude adjustment needs to be made.

4. The receiving device according to claim 1, wherein the loss determining device includes:

a positive-number calculating section that calculates number of the results of the quantizing each having a positive value out of the results of the quantizing each indicating the amplitude of the signal waveform;

a negative number calculating section that calculates number of the results of the quantizing each having a negative value out of the results of the quantizing each indicating the amplitude of the signal waveform; and a determination executing section that obtains a difference between the number calculated by the positive-number calculating section and the number calculated by the negative-number calculating section and compares the difference with a previously set fourth threshold value, thereby determining on the basis of a result of the comparing whether or not amplitude adjustment needs to be made.

5. The receiving device according to claim 1, wherein the loss determining device includes:

an envelope calculating section that calculates an envelope of the signal waveform on the basis of the results of the quantizing each indicating the amplitude of the signal waveform; and a determination executing section that compares the envelope calculated by the envelope calculating section with a reference envelope calculated beforehand, thereby determining whether or not the amplitude adjustment needs to be made.

6. The receiving device according to claim 1, wherein when the transmission unit signal received in a time series is lost in a case of executing the amplitude adjusting processing in a unit of the produced data accommodated in one transmission unit signal, a time period just after the produced data corresponding to the lost transmission unit signal is an object to be subjected to processing of the amplitude adjusting.

7. The receiving device according to claim 5, wherein when the transmission unit signal received in a time series is lost, the reference envelope is calculated from the signal waveform relating to the produced data immediately preceding produced data corresponding to the lost transmission unit signal.

8. A receiving method for receiving a transmission unit signal that is sent from a communication terminal and accommodates a result of dividing, the result of the dividing being obtained by quantizing a value based on relative differences between a plurality of sampling values having temporal prior-posterior relationship therebetween, and dividing data produced in a time series in accordance with a result of the quantizing, at the communication terminal, the receiving method comprising the steps of:

determining whether or not an amplitude adjustment needs to be made in accordance with a value of an amplitude of a signal waveform indicated by a decoding result of the produced data accommodated in the transmission unit signal, by a loss determining device; and transparently passing the signal waveform when the loss determining device determines that the amplitude adjustment does not need to be made, and performing the amplitude adjustment to pass the signal waveform when the loss determining device determines that the amplitude adjustment needs to be made, by an adjuster, wherein the amplitude adjustment is made by any one of:

shifting a waveform axis of the signal waveform, making an absolute value of the amplitude of the signal waveform smaller than a predetermined reference amplitude, and attenuating the amplitude of the signal waveform at a given rate of attenuation.

* * * * *